US005872534A

United States Patent [19]

Mayer

[11] Patent Number: 5,872,534

[45] Date of Patent: Feb. 16, 1999

[54] HIGH FREQUENCY BROADBAND ABSORPTION STRUCTURES

[75] Inventor: Ferdy Mayer, Paris, France

[73] Assignee: Fair-Rite Products Corporation, Wallkill, N.Y.

[21] Appl. No.: 942,166

[22] Filed: Oct. 1, 1997

[51] Int. Cl.[6] ..... H01Q 17/00

[52] U.S. Cl. ..... 342/1

[58] Field of Search ..... 342/1, 2, 3, 4

[56] References Cited

U.S. PATENT DOCUMENTS

| | | | |
|---|---|---|---|
| 5,276,448 | 1/1994 | Naito et al. | 342/1 |
| 5,323,160 | 6/1994 | Kim et al. | 342/1 |
| 5,708,435 | 1/1998 | Kudo et al. | 342/1 |

*Primary Examiner*—Ian J. Lobo
*Attorney, Agent, or Firm*—Anthony J. Casella; Gerald E. Hespos; Ludomir A. Budzyn

[57] ABSTRACT

An electromagnetic wave absorber, having two or more magnetic layers for broadening the reduced reflectivity frequency bands, and formed of materials with staggered magnetic dispersion loss spectra. A high permeability nickel-zinc ferrite, rich in zinc, e.g., 0.7 molZn, 0.3 molNi is used as a reference absorber layer adjacent to a ground plane. The successively higher frequency spectra are related to the outer layers and the successively higher loss spectra are achieved by using higher magnetization soft ferro or ferrimagnetics, higher anisotropy semi-hard or hard ferro-ferrimagnetic material, or synthesized "smart" materials, for simulating magnetic loss dispersion. The successive layers are decoupled one from another by any of electrical, magnetic, and/or structural arrangements. The decoupling may be implemented by a significant difference in the frequencies at which the maximum values of the magnetic loss vs. frequency occurs for each layer. Alternatively, the decoupling may be implemented by a significant difference in the optical index of the material in each layer in a decreasing order towards the outside. Also, the decoupling may be implemented by the intercalation of higher wave impedance and low optical index layers increasing the apparent wave impedance presented from one to the next magnetic layer. Using these implementations the wave-absorber frequency range may be extended from about 30 MHz to 3 GHz and above.

21 Claims, 7 Drawing Sheets

HIGH FREQUENCY BROADBAND ABSORPTION STRUCTURES

BACKGROUND OF THE INVENTION

1. Field of the Invention

The present invention relates to electromagnetic wave absorbing structures and more particularly to multilayered or laminated electromagnetic wave absorbers with an extended frequency range, e.g., from under 30 Mhz up to 3 GHz and beyond to 18 GHz and above.

2. Description of the Prior Art

Electromagnetic wave absorbers made with a single layer of state-of-the-art ferrite achieve a vertical incidence/reflective performance of the order of 15 dB for frequencies from about 25 MHz to 600 MHz. For the EMC-frequency band, needing 30 MHz to 1 GHz (with provisions of up to 3 GHz), such a one-layer ferrite clearly lacks adequate performance. More appropriately, so-called superwide band absorbers make use of combinations of ferrite tiles and superposed flat layer materials on a metallic substrate in various known structural forms that achieve a relectivity R for vertical incidence better than 20 dB in a "superwide band" from 30 MHz to 3 GHz. However, the design of these structures has to take into account six variables for each layer, which can vary independently, i.e., Epsilon', Epsilon" or Sigma, Mu', Mu", d, and f, so that two permittivity ($\epsilon$) values, two permeability ($\mu$) values, layer thickness, and wave frequency are involved for just one of the plurality of layers. Therefore, R optimization becomes more difficult for each additional layer, even in the simple case of isotropic materials and an ideal conductive substrate.

Attempts at computer simulations of these structures have difficulties with identifying physical approaches to optimization and rarely offer insights on the electromagnetic phenomena involved, as well as never making a correlation with the feasibility of the material. Many layered broadband absorbers utilizing magnetic materials have been described in various publications since 1945 when broadband absorptive materials became of interest as radar absorptive materials (RAM). More recently, an article by Kim, Kim, and Hong in IEEE Transactions on Magnetics, Vol. 29, #3, July 1993, pps. 2134–2138, entitled, "A study on the Behavior of Laminated Electromagnetic Wave Absorbers", describes a double "ferrite against ferrite" layer absorber, where the center frequency of the absorber is changed between the frequencies of each ferrite. Further, U.S. Pat. No. 5,323,160, issued Jun. 21, 1994 to the foregoing authors, describes the same absorber wherein the "materials have different attenuation characteristics and are affixed to each other". Related magnetic spectra are shown by the same authors in the publication, J. Korean Institute Telemat. Electron. (South Korea), Vol. 28a, #8, pps. 9–14, August 1991, "Behavior of Laminates of Ferrites on Electromagnetic Wave Absorbers".

It has been observed that such qualities and implementations do not broaden and enhance the useful absorptive spectrum, where the em wave reflection is reduced by 20 dB, for instance. In fact two ferrites that have been considered have shown different magnetic permeability mu* spectra in the 30 MHz 1 GHz range but very similar mu* spectra in the 1 GHz range. With such structures no extension of this frequency is physically possible.

It is therefore a problem in the art to achieve a desirable range of useful absorptive spectra with current multilayered, electromagnetic wave absorbers.

It is accordingly an object of the present invention to provide an improved layered broadband electromagnetic wave absorber with a broadened and enhanced useful absorptive spectrum.

It is another object of the invention to provide an improved multilayered electromagnetic wave absorber with an extended frequency range from under 30 Mhz up to 3 GHz and beyond to 18 GHz and above.

It is a further object of the invention to provide an improved multilayered, electromagnetic wave absorber with a broadened and enhanced useful absorptive spectrum above 1 GHz with different mu* spectra for the layer materials and magnetic loss dispersion spectra.

It is also an object of the invention to provide an improved multilayered, electromagnetic wave absorber with a broadened and enhanced useful absorptive spectrum above 1 GHz and "decoupling" of the layers, i.e., reducing of the inherent coupling effect between the adjacent layers, by one or more of the following ways:

- increasing the relative wave impedances by staggering the permittivity spectra of the layers;
- reducing the dielectric constants from the inside (against the ground reference) to the outside;
- separating the permeability dispersion loss spectra in the frequency domain; or
- adding intermediary layers of high relative wave impedance, including air layers.

It is an additional object of the invention to provide an improved multilayered, electromagnetic wave absorber with two ferrite layer implementations involving 30 MHz to 3 GHz absorbers using ferrites with different dispersion spectra and using one of the several dispersion techniques above.

It is an additional object of the invention to provide an improved multilayered, electromagnetic wave absorber with a number of two ferrite layer implementations of 30 MHz to 18 GHz absorbers using ferrites with well separated dispersion spectra and one of the several dispersion techniques above.

It is an additional object of the invention to provide an improved multilayered, electromagnetic wave absorber with a broadened and enhanced useful absorptive spectrum below 30 MHz where the coupling effects are small using the above techniques.

It is an additional object of the invention to provide an improved multilayered, electromagnetic wave absorber using a number of "smart materials", i.e., new ferri- and/or ferromagnetic materials as contemplated and synthesized in view of the desired or needed permeability and permittivity spectra, following the above rules of staggered magnetic dispersive loss spectra and/or the rules of decoupling of the successive layers of the absorbers.

SUMMARY OF THE INVENTION

The present invention involves electromagnetic wave absorbers having two or more magnetic layers for broadening the reduced reflectivity frequency bands. An absorber in accordance with the invention is formed of a number of layers of materials with staggered magnetic dispersion loss spectra. A conventional high permeability nickel-zinc ferrite, rich in zinc, e.g., 0.7 molZn, 0.3 molNi may be conveniently used as a reference absorber layer placed adjacent to a ground plane. The successively higher frequency spectra are related to the outer layers and the successively higher loss spectra are achieved by using one of higher magnetization soft ferro or ferrimagnetics, higher anisotropy semi-hard or hard ferro-ferrimagnetic material, or synthesized "smart" materials, for simulating magnetic loss dispersion. Further, the successive layers are decoupled one from another by, e.g.,: increasing the relative wave impedances by staggering the permittivity spectra of the layers; reducing the dielectric constants from the inside layer, against the ground reference, to the outside; separating the permeability dispersion loss spectra in the frequency domain; or adding intermediary layers of high relative wave impedance, including air layers. The decoupling may be implemented by a significant difference in the frequencies at which the maximum values of the magnetic loss vs. frequency occurs for each layer. Alternatively, the decoupling may be implemented by a significant difference in the optical index of the material in each layer in a decreasing order towards the outside. Also, the decoupling may be implemented by the intercalation of higher wave impedance and low optical index layers increasing the apparent wave impedance presented from one to the next magnetic layer. Using these implementations the wave-absorber frequency range may be extended from about 30 MHz to 3 GHz and above.

BRIEF DESCRIPTION OF THE DRAWINGS

The present invention will be described in more detail below with reference to the accompanying drawings in which:

FIG. 6 shows the reflection, R, spectrum for a first absorber implementation with the anisotropic ferrite of d2 placed adjacent to the soft ferrite of d1, wherein:

curve (a) shows there is a clear decoupling between two adjacent ferrite layers because of the clearly separated magnetic loss spectra and a better than 10 dB reflectivity is achieved from about 15 MHz to about 15 Ghz:

curve (b) shows the effect of an additional decoupling due to permittivity staggering (high inside, low outside, e.g., increasing the inner ferrite permittivity to 25 and/or decreasing the outer to 4);

and curve (c) illustrates the possibility of achieving a better than 15 dB reflectivity absorber, from 20 MHz to about 15 GHz, with an air gap between 8 mm and 15 mm.

Figure 7:
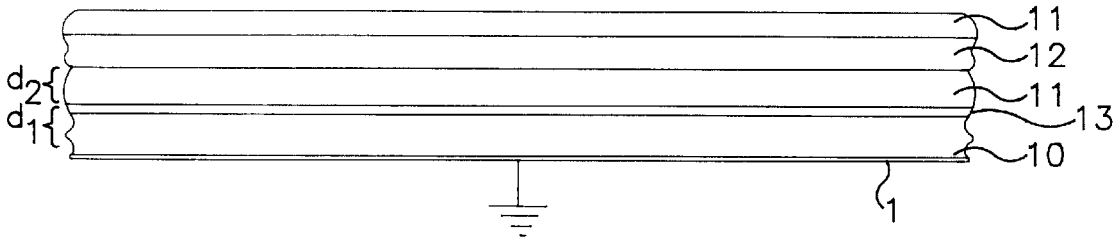

FIG. 7 is a diagrammatic view in section of a multilayer wave absorber of the type of the present invention.

DETAILED DESCRIPTION OF THE PREFERRED EMBODIMENTS

The present invention is directed to providing an electromagnetic wave absorber capable of broadening the reduced reflectivity frequency bands over those currently obtainable. An absorber in accordance with the invention is formed of two or more magnetic layers, such as shown in FIG. 7, composed of materials with staggered magnetic dispersion loss spectra. The inner layer 10 is disposed adjacent to a ground plane, e.g., a grounded metallic substrate 1, and the outer layers, 11–n, are of successively higher frequency spectra and the successive higher loss spectra are achieved by simulating magnetic loss dispersion using such materials as higher magnetization soft ferro or ferrimagnetics, higher anisotropy semi-hard or hard ferro-ferrimagnetic material, or synthesized "smart" materials. Further, the successive layers are decoupled one from another by means of any of electrical, magnetic, and/or structural arrangements that will reduce the inherent coupling effect between the adjacent layers by, e.g.,: increasing the relative wave impedances by staggering the permittivity spectra of the layers; reducing the dielectric constants from the inside (against the ground reference) to the outside; separating the permeability dispersion loss spectra in the frequency domain; or adding intermediary layers (12) of high relative wave impedance, including air layers 13. For example, the decoupling means may be implemented by a significant difference in the frequencies where the maximum values of the magnetic loss vs. frequency occurs for each layer. Alternatively, the decoupling means may be implemented by a significant difference in the optical index of the material in each layer in a decreasing order towards the outside. Also, the decoupling means may be implemented by the intercalation of higher wave impedance and low optical index layers increasing the apparent wave impedance presented from one to the next magnetic layer. Using these implementations the wave-absorber frequency range may be extended from about 30 MHz to 3 GHz and above.

A particular ferrite commonly used in wave absorber applications is high permeability nickel-zinc ferrite, rich in zinc, e.g., 0.7 molZn, 0.3 molNi. In the following descriptions of the embodiments of the invention this ferrite will be used as a reference absorber layer (10) placed adjacent to a ground plane. Typical values of the complex permeability spectrum of this ferrite are as set forth in TABLE 1.

TABLE 1

| Freq. | 3 MHz | 10 | 30 | 100 | 200 | 300 | 600 | 1 GHz | 1.5 | 2 | 2.5 | 3 GHz |
|---|---|---|---|---|---|---|---|---|---|---|---|---|
| Mu' | 963 | 259 | 46.7 | 6.94 | 2.20 | 0.89 | 0.59 | 0.80 | 0.89 | 0.98 | 0.99 | 1 |
| Mu" | 909 | 557 | 233 | 75.5 | 39.2 | 26.5 | 13.3 | 7.92 | 5.86 | 3.79 | 2.43 | 1.07 |

The permittivity, $\epsilon$, of such a ferrite is approximately constant, and equal to 15 over the indicated frequency range, with dielectric losses being negligible. This kind of an absorber is typically state of the art for applications in absorber lined chambers, working in the 30 MHz to 1 GHz frequency range.

Figure 1:
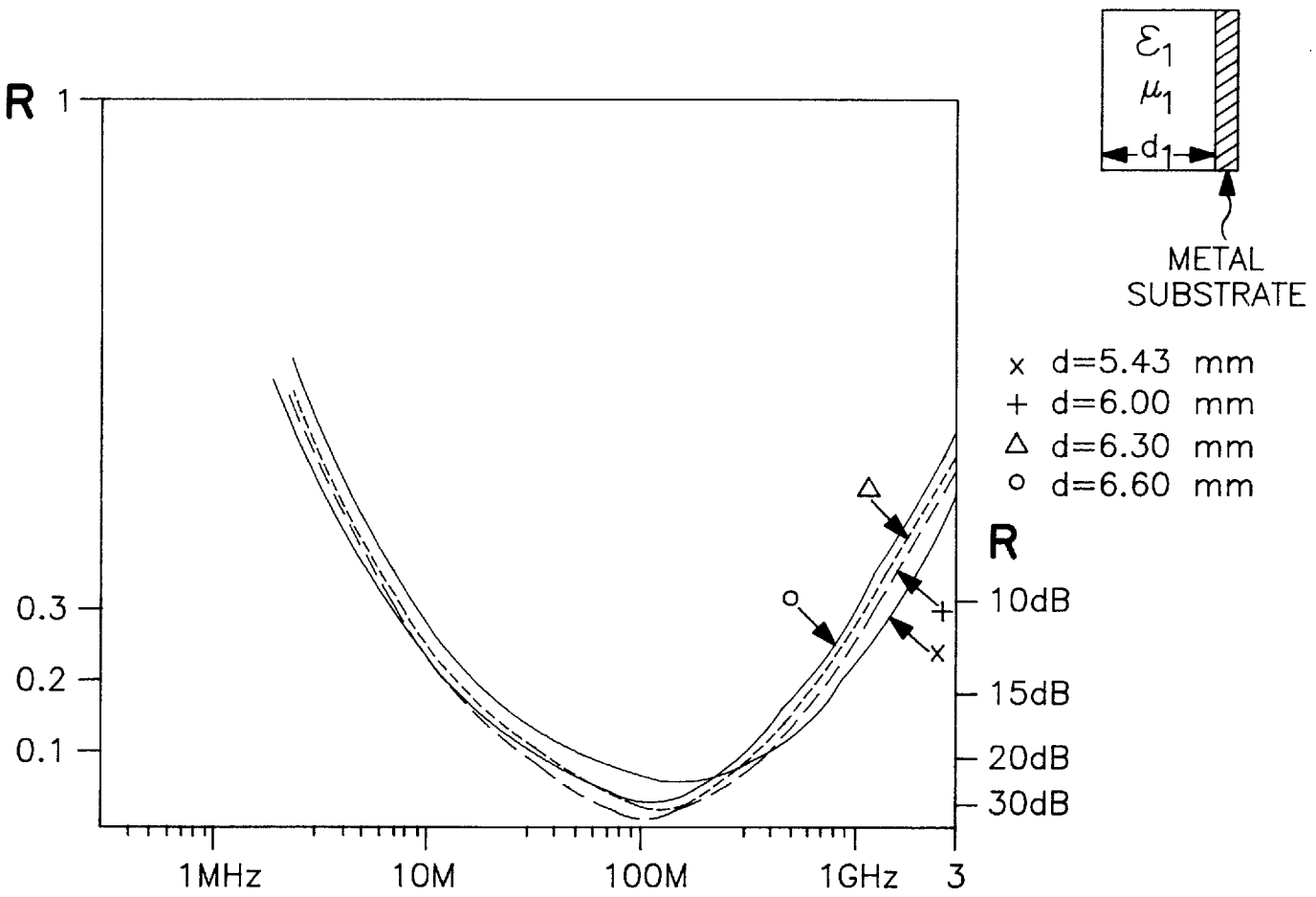
FIG. 1 is a plot of the wave reflection, R, vs. frequency illustrating the reflection spectrum of a typical ferrite tile absorber, for different thicknesses and absorptions, of the type which may be used in accordance with the invention.

The related wave reflection R for the 3 MHz–3 GHz frequency range of such a ferrite tile is shown in FIG. 1, which illustrates the values of reflectivity, R, equal to 20 log10 1/R, for different tile thicknesses d. d=6.3 mm corresponds to the common commercial tile thickness. It will be seen that a 20 dB reflectivity, i.e., R=0.1, typically needed for absorptive chamber implementations, is achieved for d=6.3 mm for about 30 MHz. It is apparent too, that the performances decrease to some 12 dB at 1 GHz, so that, clearly, there is a need to improve the very high frequency performance. At 3 GHz the reflectivity is some 6 dB, which is practically useless. Also, it is noteworthy that the lower frequency reflectivity is directly proportional to the thickness of the tile, although this can be improved at the expense of the high frequency reflectivity. Another important feature consists in the disappearance of all magnetic effects above 3 GHz; in other words, as noted, such a ferrite, though very good as a 30 MHz–1 GHz absorber, is unusable for frequencies above that range.

A very high frequency improvement, according to the invention, uses a second (outer) layer which still shows magnetic effects in the higher frequency range, i.e., extending towards 5 GHz and above. Applying basic physics, such a result can be achieved, in soft ferri- and ferromagnetic materials, by using higher saturation magnetization materials, such as:

lower content Ni—Zn ferrite (with 0.5 mol Ni, 0.5 mol Zn, for example) but not a pure Ni ferrite;

higher Ms soft ferrites, like Mn—Zn, or mixed Mn—Zn/Ni—Zn ferrites;

higher Ms soft ferromagnetic material made insulating by a thin layer of composite implementation (very fine carbonyl iron, very fine amorphous alloy);

Mn—Zn—Fe ferrites, substituted Fe ferrites, with magnetite as a border case, use of dipole and/or chiral loading of the ferrites;

in semi-hard to hard ferri—ferromagnetic materials, using anisotropic materials with a dispersion spectrum in the higher frequency range;

anisotropic ferrites like Ni—Co, Ni—Fe—Co, Ni—Zn—Co, Co—Nb—Zr, etc.; and ferrites with hexagonal crystal structure (wherein the basal plane is the preferred plane of magnetization), which show a higher dispersion frequency than in the case of spinels.

Figure 2:
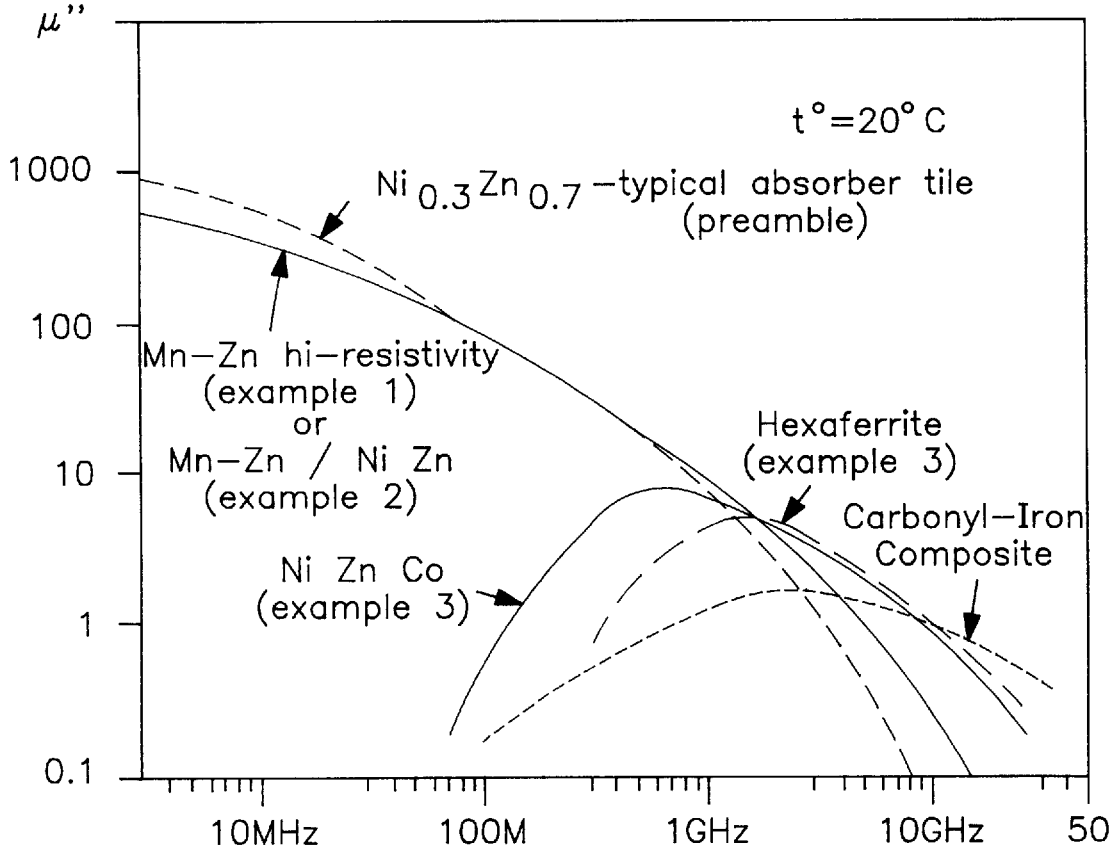
FIG. 2 is a plot of permeability, $\mu''$, vs. frequency showing a number of magnetic loss spectra for ferrites used in Examples 1–3 of the invention illustrating the very high frequency extension due to the higher saturation magnetization soft ferrites and to harder materials.

In FIG. 2 are shown a number of magnetic loss spectra, using examples drawn from the above list and chosen in view of the examples to be described below. FIG. 2 shows clearly the very high frequency extension due to the higher saturation magnetization soft ferrites and due to harder materials.

Considering essentially the thin layer absorber approach which has to use low dielectric losses, a number of examples will be described.

Example 1

By way of an initial example, as the outer layer in a two layer absorber, an Mn—Zn ferrite, of high resistivity, is achieved by a default in the iron stoichiometry and minor additions, adding to a global high resistivity. This ferrite and its composites, because of its saturation magnetization, which is higher than the above mentioned Ni—Zn ferrites of the inner layer, produce a very high frequency improvement of the permeability, as shown in TABLE 2.

TABLE 2

| Freq. | 3 MHz | 10 | 30 | 100 | 200 | 300 | 100 | 1 GHz | 1.5 | 2 | 2.5 | 3 GHz |
|---|---|---|---|---|---|---|---|---|---|---|---|---|
| Mu' | 508 | 201 | 90.5 | 24.0 | 7.00 | 2.75 | 0.48 | 0.02 | 0.16 | 0.18 | 0.50 | 0.6 |
| Mu" | 536 | 277 | 155 | 73.4 | 41.7 | 28.4 | 14.1 | 8.36 | 5.36 | 3.39 | 2.68 | 2.16 |

The permittivity of this ferrite is also approximately constant and equal to 15 over the frequency range, while the dielectric losses are negligible. If the lower frequency permeability is somewhat smaller than for the Ni—Zn ferrite, the mu* extends substantially to higher frequencies, as compared to the values in the above TABLES 1 and 2. This ferrite is thus an excellent selection, and preferred in accordance with the invention, for a second layer.

In a preferred two layer design then, the first layer (against the ground backing) may be of Ni—Zn ferrite of a thickness of d1=4.0 mm, and the second layer (towards the exposed side) may be of the above high resistivity Mn—Zn ferrite of a thickness d2=1.86 mm, i.e., a total thickness of 5.86 mm, which is a little smaller than the single layer ferrite absorber described with regard to TABLE 1. Low frequency reflectivity is somewhat reduced. In fact, at lower frequencies, the short circuit impedances Z1sc and Z2sc of the ferrite layers simply add, and the 20 dB at 30 MHz attenuation merely needs a little increase of either d1 or d2, or of the two, which will be demonstrated later.

Figure 3:
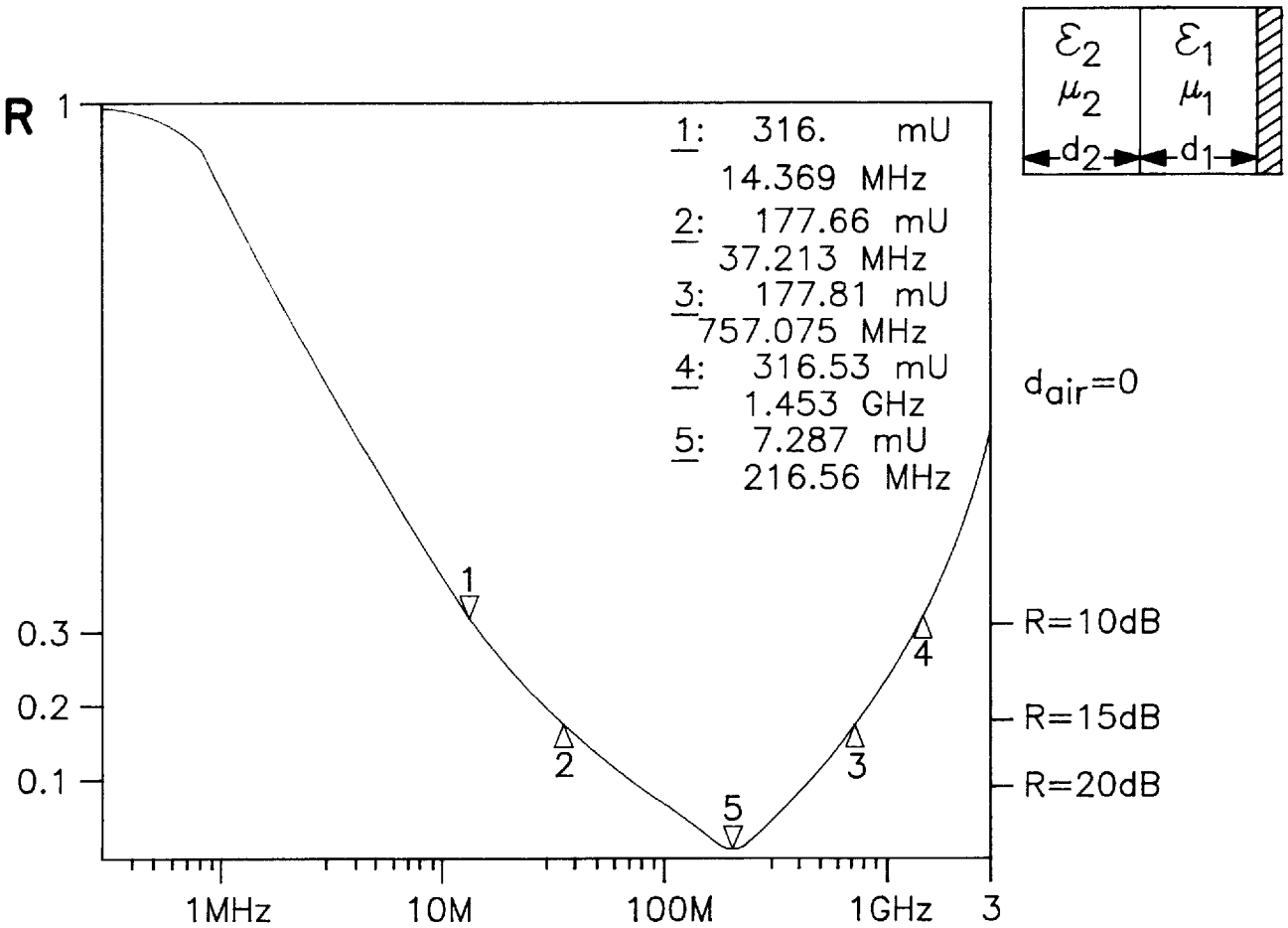
FIG. 3 is a plot of the wave reflection, R, vs. frequency showing the measured reflections of an adjacent combination of two ferrites at 20° C., with the d1 layer against the metallic substrate and the d2 layer oriented on the exposed side and an air gap of 0 mm.

FIG. 3 shows the measured reflections of the adjacent combination of the two ferrites, with the d1 layer 10 against the grounded metallic substrate 1 and the d2 layer 11 oriented on the exposed side and the air gap 13 $d_{air}$=0. Clearly the response curve is similar to the curve of a bulk ferrite layer, i.e., there is no appearance of the expected effects of the higher magnetization layer. The reason for this has been found to be the fact that the close contact implementation of the two layers introduces a strong coupling effect, which may be demonstrated to be equal to:

1+(Z1sc/Z2oc)

where Z2oc is the open circuit impedance of layer 11. Accordingly, the sum of the basic short circuit impedances Z1sc and Z2sc, mentioned above, representing the behavior of each layer as an independent absorber against ground, is reduced by this "coupling factor", which is always bigger than one, and of growing importance for the higher frequencies.

In keeping with the invention, several ways have been developed to "decouple" the layers, i.e., to obtain a global absorber spectrum equal to the sum of the individual layer spectra. An example of one solution consists in the addition of a higher wave impedance, lower loss layer, where an air layer is the extreme case, in which event Z2oc corresponds to the air layer and will be higher and purely reactive. By adding, on top of the first ferrite layer 10 placed against the ground surface, such an isolating layer of thickness 1, the coupling term above has been found to become:

1−j Z1sc (beta)1 where the electrical length of the isolating layer (air) (beta)l is smaller than the wavelength in the upper frequency region considered. The wave impedance on top of the isolating layer is:

$$\frac{Z1cs + j\,(\text{beta})1}{1 - j\,Z1sc\,(\text{beta})1}$$

that is, increased and thus representing an isolation towards an additional ferrite layer 11.

Figure 4:
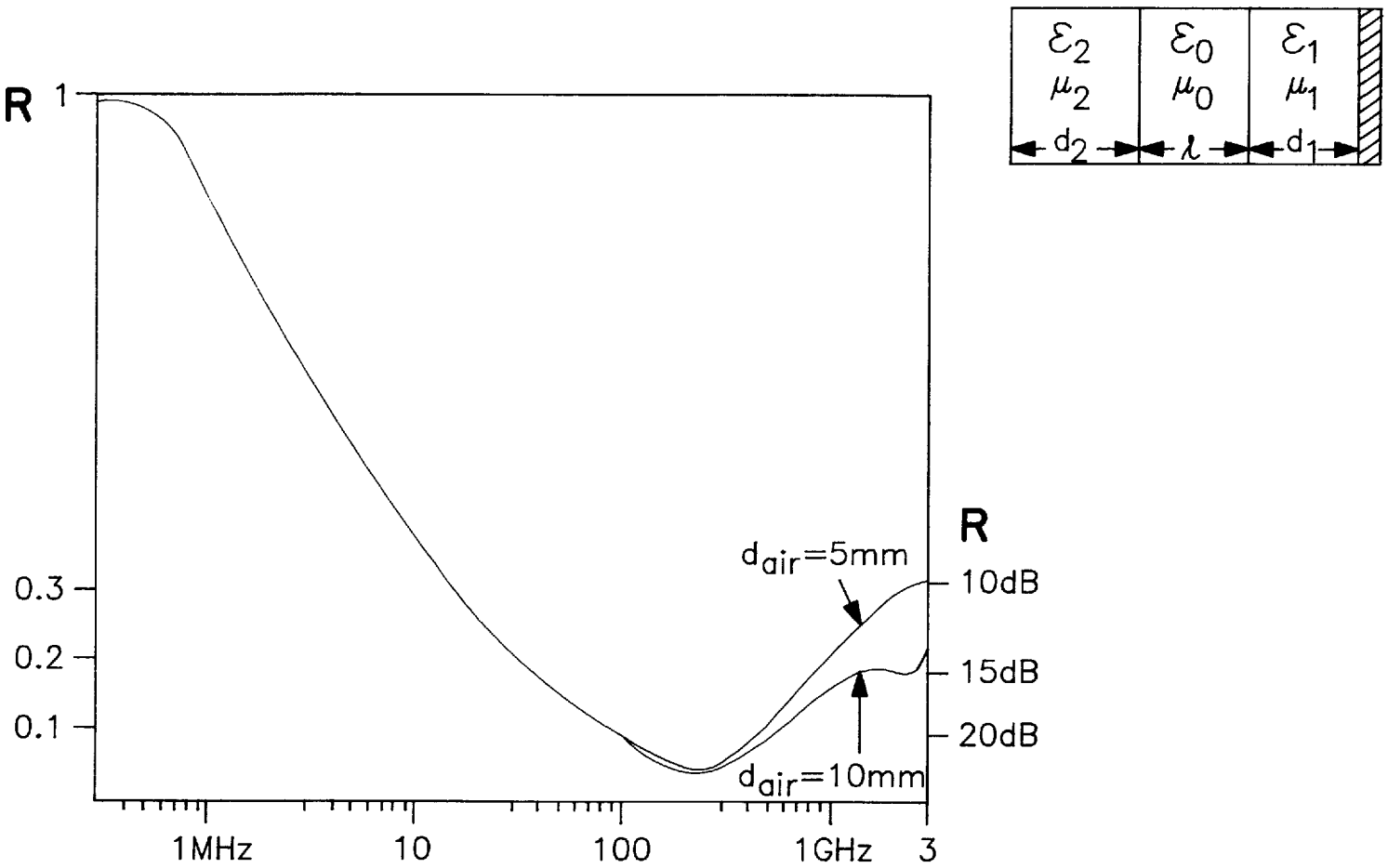
FIG. 4 is a plot of the wave reflection, R, vs. frequency as in FIG. 3 showing the measured reflections for air gaps of 5 mm and 10 mm.

FIG. 4 shows the reflection coefficient of this implementation, with the ferrite 10 of TABLE 1, against ground, of a thickness d1=4.0 mm, a variable air gap 13 (as indicated), and the higher frequency magnetic dispersion ferrite 11 of TABLE 2 of a thickness d2=1.86 mm, on top. It will be seen from FIG. 4 that increasing the air gap from 0 to 5.0 mm makes the decoupling appear and for an air gap of 10.0 mm, the decoupling is close to optimum. As shown the resonance proper to the ferrite of d2 dispersion appears to be around 2.5 GHz and stays for an air gap of up to approximately 15 mm.

The frequency range of this multilayer absorber has been extended to over 3 GHz, with a reflectivity of better than 15 dB. No optimization has been attempted for this design, but a better adjustment of the thicknesses indicates a possibility of over 20 dB.

Of course, a magnetic gapped bulk ferrite, such as a composite material may also be used that is made with the higher magnetization ferrite characterized in TABLE 2, and will increase the term Z2oc, while decreasing still further the coupling factor since the dielectric constant of the composite material is smaller than that of the bulk ferrite. In such case, the contribution of the second layer 11 to the overall impedance (Z1sc+Z2sc) is smaller, so that a thicker first ferrite layer against ground is selected to start assembling an absorber. Accordingly, a ferrite thickness of d1=6.35 mm is chosen for the first layer with an air gap of 15 mm. Then, an outer ferrite composite layer of ferrite volume concentration of 66% and ferrite weight concentration of 92%, with a lower permittivity of 5.5 instead of 15, and a thickness d2=3.0 mm, is chosen so as to achieve a (Z1sc+Z2sc) value close to 377 ohms, i.e., the absorber lower frequency reflectivity maximum.

Figure 5:
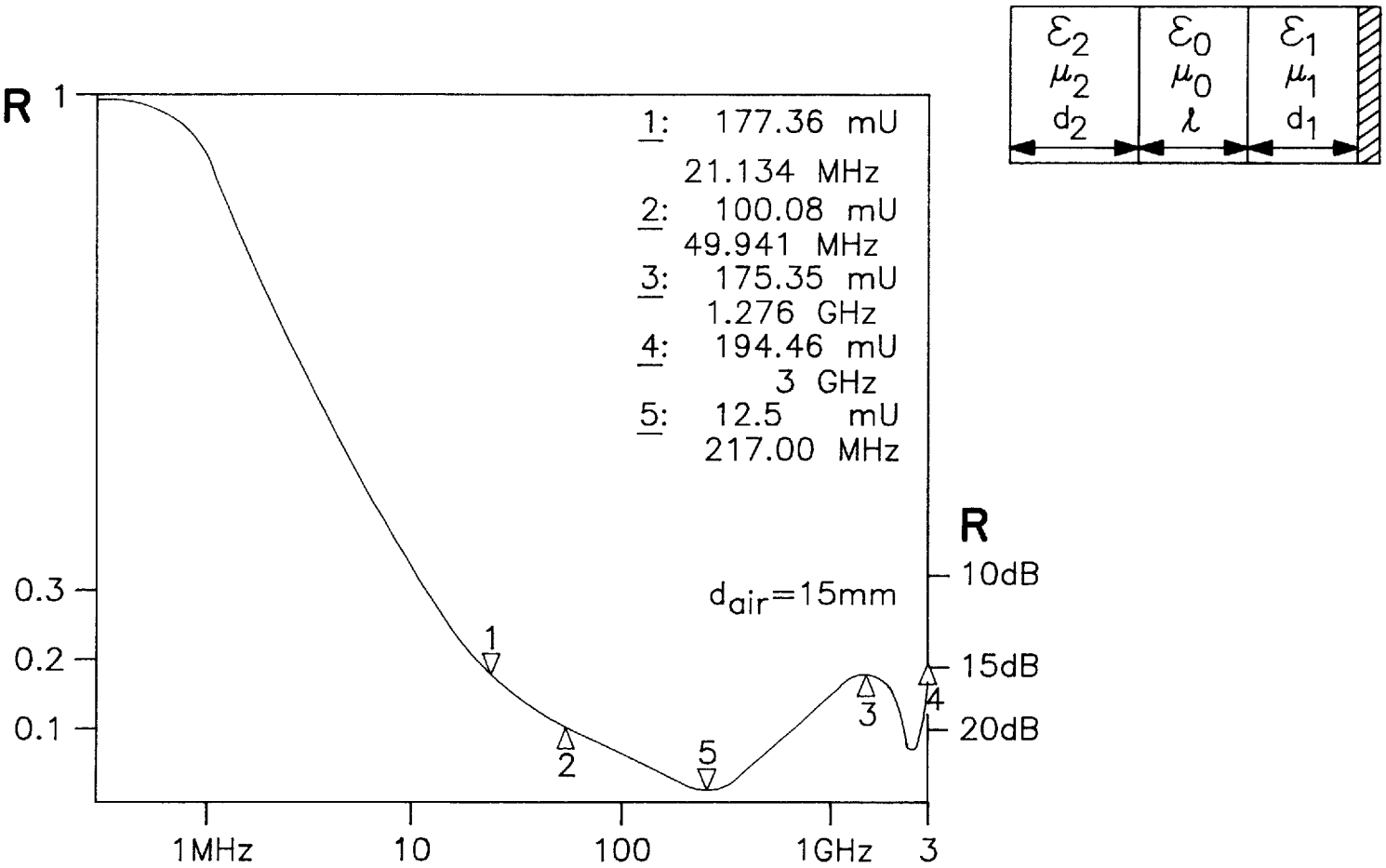
FIG. 5 is a plot of the wave reflection, R, vs. frequency as in FIG. 3 showing the measured reflections for an air gap of 15 mm.

The reflection coefficient of this multilayer absorber as compared to the single layer absorber of TABLE 1, with the thickness d2 chosen so as to represent the dispersive resonance around 2.5 GHz, shows an improved low frequency reflection with an extension of an over 15 dB reflectivity up to and over 3 GHz, according to the invention. This is seen in FIG. 5. While this example applied a higher saturation magnetization ferrite of the Mn—Zn type, as noted above, other high Ms ferrites/ferrite mixtures and/or ferromagnetic powder composites may be found suitable for this application. This example too shows the advantage of composite materials for the upper layers 12–n, as their permittivity can be smaller and their resistivity higher than that of a bulk ferrite; additionally, for the very high frequencies, their magnetic loss dispersions become more and more identical.

Example 2

The preceding example shows the limitation of dispersive magnetic loss spectra extension, based upon higher magnetization soft ferrite. Another example of a somewhat higher Ms can be achieved with the above mentioned mixed Mn—Zn/other high resistivity ferrites, and mixed substituted Fe ferrites/other high resistivity ferrites, such as disclosed in applicant's European Patent No. 87-401 457.4. Also, a recently synthesized high Ms Mn—Zn/Ni—Zn mixed ferrite showing Mu" values of 11.5 at 1 GHz, 2.4 at 3 GHz and approximately 0.7 at 5 GHz, is a good selection for an up to 5 GHz absorber.

Example 3

In a third example, the "decoupling" described can be achieved, between several ferri or ferrimagnetic layers, using a second (outer) layer of a magnetic loss spectrum even more clearly separated from that of the first layer, and implemented with anisotropic ferrite of the substituted hexagonal type Co ferrites, and the like. The very high frequency extension of the magnetic loss dispersion spectrum of a Ni—Zn—Co ferrite with high Co content (spectrum one order of magnitude higher than the TABLE 2 ferrite) and tightly controlled stoichiometry, as a typical example, is shown in TABLE 3.

TABLE 3

| Freq. | 3 MHZ | 10 | 30 | 100 | 300 | 1 GHz | 3 | 10 | 20 GHz |
|---|---|---|---|---|---|---|---|---|---|
| Mu' | 10 | 10 | 10 | 10 | 9 | 4.0 | 2.3 | 1.2 | 1 |
| Mu" | 0 | 0 | 0 | 0.5 | 4.5 | 6 | 3.0 | 0.85 | 0.3 |

The permittivity of such a ferrite is approximately constant and equal to 7.3 over the frequency range; again dielectric losses are negligible. It is straightforward to consider that, with a value of (Z1sc+Z2sc) close to 377 ohms for the lower frequency reflectivity maximum, a starting value of about d1=5.0 mm is appropriate in selecting the basic ferrite layer, as the maximum reflectivity spectrum of Z2sc is placed in the very high frequency range, around 10 GHz, for a thickness chosen at, e.g., 2.5 mm.

Figure 6:
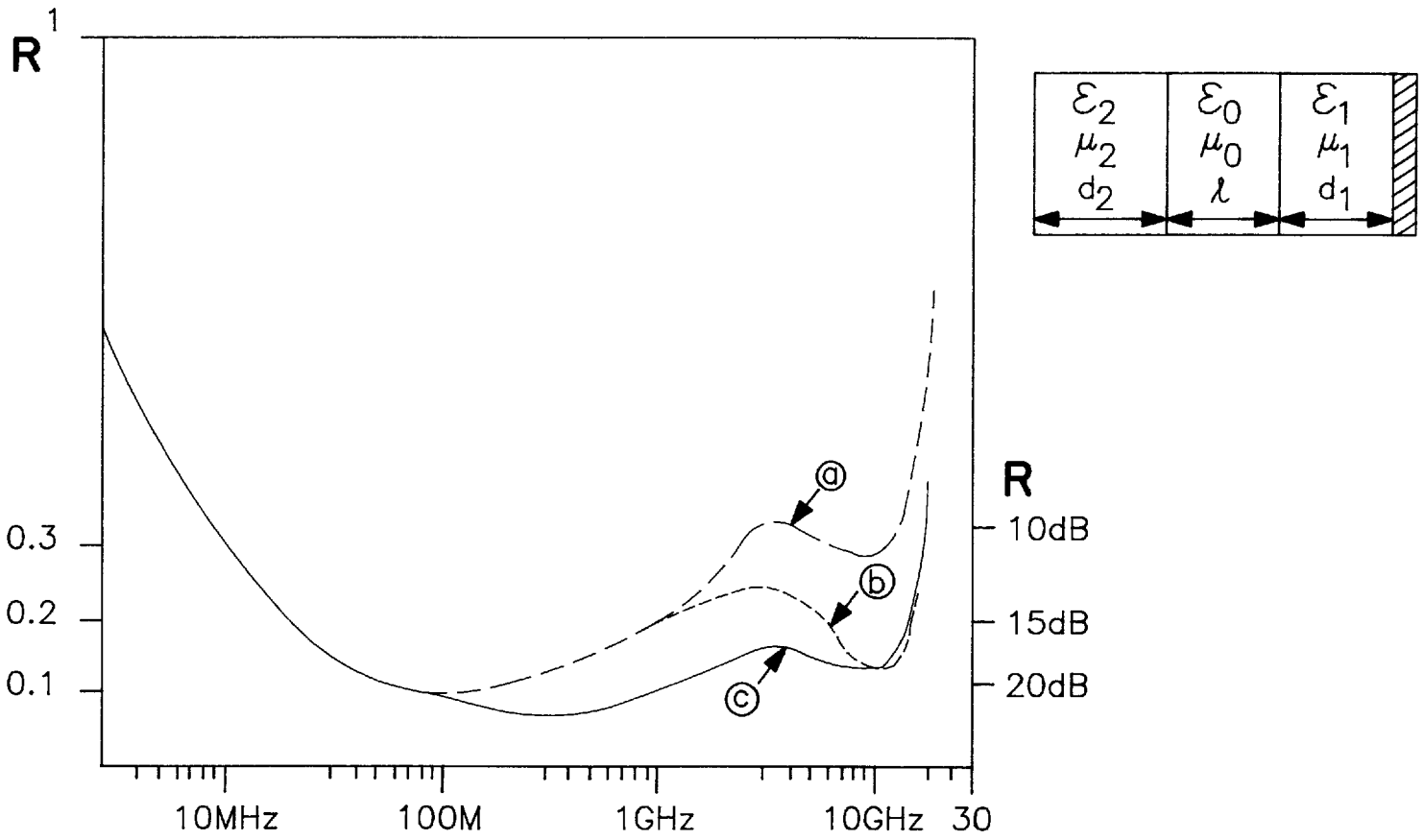

In a first absorber implementation, the anisotropic ferrite of layer (11) d2 is placed adjacent to the soft ferrite of layer (10) d1. The corresponding reflection spectrum is shown in FIG. 6 (curve a). This time there is a clear decoupling between the two adjacent ferrite layers, 10 and 11, because of the clearly separated magnetic loss spectra, a better than 10 dB reflectivity is achieved from about 15 MHz to about 15 GHz. An additional decoupling can be done with the above mentioned permittivity staggering (high permittivity inside, low permittivity outside) increasing the basic inner ferrite permittivity (TABLE 1) to 25 and/or decreasing the outer ferrite permittivity (TABLE 3) to 4. FIG. 6 (curve b) shows the expected improvement of reflectivity due to this further decoupling. It is important to note concerning the synthesis of such "ad hoc" permittivities, that the increase of the dielectric constant for the inner ferrite can be done by impregnating the ferrite powder, before firing, with high dielectric constant metallic oxides, creating barrier layers (see, for example applicant's European Pat. No. 91-402 059-9) by the inclusion of small metallic fibers and/or by the inclusion of chiral particles in the ferrite (frequency selective materials and/or surfaces). The decrease of the dielectric constant for the outer ferrite can be achieved by porous bulk ferrite or by the implementation of composite materials as described above. Also, as noted above, a final implementation of the decoupling consists in the introduction of an air gap 13 between the inner ferrite 10 (TABLE 1) and outer ferrite 11 (TABLE 3). Curve c of FIG. 6 shows the possibility of achieving a better than 15 dB reflectivity absorber from 20 MHz to about 15 GHz with an air gap 13 between 8 and 15 mm. According to the invention the air gap(s) between layers can be replaced by inserted higher wave impedance (square root of mu/epsilon) and lower optical index (square root of mu.epsilon) layer(s), increasing the apparent wave impedance on top of the layers. Indeed, the above condition calls especially for lower permittivity dielectric layers.

Example 4

In Example 1 above the two-layer ferrite absorber with the first bulk ferrite of TABLE 1 and second bulk ferrite of TABLE 2 used thicknesses d1=4.0 mm and d2=1.86 mm, i.e., a total thickness of 5.86 mm. This compares favorably with the optimum tile thickness of d1=6.35 mm when the first ferrite is used alone. Thus, it will be seen that the invention makes it possible to improve frequency performance with less material and less weight.

The second implementation used a thickness of d1=5.00 mm and a thickness for the composite of d2=3.0 mm that amounts to an increase of 5.00+(3.0×0.92)=7.76 mm. This again compares with 6.35 mm for the one layer absorber, if the weight of the air gap is neglected, or the equivalent high impedance intermediary layer implementations are ignored.

It is important to note, by way of another example with regard to the invention, that one can start with the known one-layer absorber (TABLE 1 material, thickness d1=6.35 mm) and consider the addition of a foam plus ferrite or ferrite composite absorber as a retrofit component. The interesting ability of such an exemplary solution to extend the very high frequency performance of existing one ferrite layer absorber lined chambers is evident.

The same idea is valid for one or several additional "air gaps" and ferrite layers. Example 3 shows the possibility of achieving a very broad frequency with a 15 dB reflectivity (20 MHz to 15 GHz and more) with two ferrite layers, so that a 20 dB or better reflectivity performance might need a 3 layer approach using, e.g., the ferrite of TABLE 1, the soft but higher saturation magnetization ferrite of TABLE 2, and a third layer 12 of an even higher saturation magnetization like the one of TABLE 3, all three magnetic materials being separated by higher impedance layers (air gap, lower permittivity dielectric, etc.).

It has been demonstrated by the disclosed examples the feasibility of such absorbers with absorptive spectra extending from 10 MHz to over 45 GHz, which present themselves as an ideal solution for progressive retrofitting of shielded chambers.

Example 5

When considering the above extremely high frequency range, the "artificial materials" described (like the decreased or enhanced permittivity ferrites, the chiral ferrites, etc., in Example 3) become increasingly easy to implement. As an example, the inclusion of metallic fibers (straight or shaped for chiral inclusions) in sintered ferrites, which can shape the dispersion permeability spectra and extend magnetic effects to the upper frequency range, independently form anisotropy, planar magnetization and/or basic saturation magnetization of the basic ferrite material.

Finally, in the foregoing descriptions essentially vertical incidence of the waves on the absorbers of the invention has been considered. It is important to note that all of the materials according to the invention, use a layered structure with a decreasing wave index (from ground to outer space). In other words, the inventive absorbers will show improved reflectivity for oblique incidence also. Consequently, the absorbers can be optimized for oblique incidence and/or for a given function of reflectivity vs, incidence angle as needed for the high performance absorber lined chambers in keeping with the invention.

While the present invention has been described in terms of specific embodiments and combinations, it will be appreciated that the invention is not limited to the particular examples presented herein, and that the scope of the protection is defined in the attached claims.

What is claimed is:

1. An electromagnetic wave absorber having two or more magnetic layers for broadening the reduced reflectivity frequency bands and comprising:

a plurality of layers of materials having staggered magnetic dispersion loss spectra, with the successively higher frequency spectra being related to the outer layers and with the successive higher loss spectra achieved by simulating magnetic loss dispersion using one of higher magnetization soft ferro or ferrimagnetics, higher anisotropy semi-hard or hard ferro-ferrimagnetic material, and synthesized "smart" materials; and means for decoupling the successive layers one from another.

2. An absorber as in claim 1 wherein the decoupling means comprises means for producing a significant difference in the frequencies where the maximum values, of the magnetic loss vs. frequency occurs for each layer.

3. An absorber as in claim 1 wherein the decoupling means comprises means for producing a significant difference in the materials optical index of each layer in a decreasing order towards the outside.

4. An absorber as in claim 1 wherein the decoupling means comprises means for producing the intercalation of higher wave impedance and low optical index layers increasing the apparent wave impedance presented from one to the next magnetic layer.

5. An absorber as in claim 1 wherein the wave-absorber frequency range is extended from about 30 MHz to 3 GHz and above.

6. An absorber as in claim 1 wherein the wave-absorber frequency range is extended from about 30 MHz to 18 GHz and above.

7. An absorber as in claim 1 wherein the wave-absorber frequency range is extended to under 30 MHz.

8. An absorber as in claim 1 wherein said plurality of layers comprises a first layer, adjacent to ground, of soft magnetic material of lower saturation magnetization, and a second outer layer of soft magnetic material of higher saturation magnetization.

9. An absorber as in claim 1 wherein said plurality of layers comprises a first layer, adjacent to ground, of soft magnetic material of lower saturation magnetization, and a second outer layer of semi-hard or hard magnetic material.

10. An absorber as in claim 1 wherein said plurality of layers comprises a first layer, adjacent to ground, of a magnetic material with the maximum value of loss permeability in the lower frequency range, and a second outer layer of a magnetic material with a maximum value of loss permeability in the higher frequency range.

11. An absorber as in claim 1 wherein said plurality of layers comprises a first layer, adjacent to ground, of a magnetic material with a higher permittivity, and a second outer layer of magnetic material with a lower permittivity.

12. An absorber as in claim 1 wherein said plurality of layers comprises a first layer, adjacent to ground, separated from a second outer layer by one of an air gap, a non-magnetic dielectric spacing, and a low permeability dielectric spacing.

13. An absorber as in claim 1 wherein said plurality of layers comprises a first layer, adjacent to ground, of s oft magnetic material of lower saturation magnetization, a second outer layer of soft magnetic material of higher saturation magnetization adjacent said first layer, and another outer layer of soft magnetic material of higher saturation magnetization than said second outer layer.

14. An absorber as in claim 1 wherein said plurality of layers comprises a first layer, adjacent to ground, of soft magnetic material of lower saturation magnetization, a second outer layer of semi-hard or hard magnetic material adjacent said first layer, and another outer layer of harder magnetic material than that of said second outer layer.

15. An absorber as in claim 1 wherein said plurality of layers comprises a first layer, adjacent to ground, of a magnetic material with the maximum value of loss permeability in the lower frequency range, a second outer layer of a magnetic material with a maximum value of loss permeability in the higher frequency range adjacent said first layer, and another outer layer of a magnetic material with a maximum value of loss permeability in a higher frequency range than that of said second outer layer.

16. An absorber as in claim 1 wherein said plurality of layers comprises a first layer, adjacent to ground, of a magnetic material with a higher permittivity, a second outer layer of magnetic material with a lower permittivity adjacent said first layer, and another outer layer of magnetic material with a lower permittivity than that of said second outer layer.

17. An absorber as in claim 1 wherein said plurality of layers comprises a first layer, adjacent to ground, of magnetic material, a second outer layer of magnetic material adjacent said first layer, and another outer layer of magnetic gapped material.

18. An absorber as in claim 1 wherein said plurality of layers comprise magnetic materials with direction independent permeabilities/permittivities.

19. An absorber as in claim 1 wherein said plurality of layers comprise magnetic materials with direction dependent permeabilities/permittivities.

20. An absorber as in claim 1 wherein said plurality of layers comprise magnetic materials with permeabilities/permittivities modified by conductive inclusions, straight or shaped to present chiral effects for the implementation of frequency selective effects.

21. An absorber as in claim 1 wherein said plurality of layers comprises a first layer adjacent to ground of magnetic material, a second outer layer of magnetic material, with a progressive reduced wave index from said first and second layer is optimized for a given oblique wave incidence.

* * * * *